US007479975B2

(12) United States Patent
Imamura et al.

(10) Patent No.: US 7,479,975 B2
(45) Date of Patent: Jan. 20, 2009

(54) PRINTER

(75) Inventors: Michinori Imamura, Fukushima-ken (JP); Hiroshi Takahashi, Fukushima-ken (JP)

(73) Assignee: Alps Electric Co., Ltd., Tokyo (JP)

( * ) Notice: Subject to any disclaimer, the term of this patent is extended or adjusted under 35 U.S.C. 154(b) by 171 days.

(21) Appl. No.: 11/088,033

(22) Filed: Mar. 22, 2005

(65) Prior Publication Data

US 2005/0212891 A1 Sep. 29, 2005

(30) Foreign Application Priority Data

Mar. 26, 2004 (JP) ..... 2004-092219
Apr. 16, 2004 (JP) ..... 2004-121623

(51) Int. Cl.
*B41J 2/325* (2006.01)

(52) U.S. Cl. ..... 347/213; 347/213

(58) Field of Classification Search ..... 399/9, 399/12; 347/5–7, 19, 213
See application file for complete search history.

(56) References Cited

U.S. PATENT DOCUMENTS 5,053,788 A * 10/1991 Tohdo ..... 347/217
6,062,669 A 5/2000 Lee
6,486,904 B1 * 11/2002 Onozato et al. ..... 347/213
6,748,182 B2 * 6/2004 Yoshida et al. ..... 399/12
7,164,491 B2 * 1/2007 Hasegawa ..... 358/1.18

FOREIGN PATENT DOCUMENTS

JP 05-155123 6/1993
JP 2002-316461 10/2002

* cited by examiner

*Primary Examiner*—Huan H Tran
(74) *Attorney, Agent, or Firm*—Brinks Hofer Gilson & Lione

(57) ABSTRACT

A printer includes an ink cartridge mounted on a main body, ink contained in the ink cartridge, a discriminating member attached to the ink cartridge and having information recorded with on the ink cartridge, the ink cartridge being discriminated by the information recorded on the discriminating member, a memory for individually storing information items of a plurality of the ink cartridges, a control unit for determining a status of ink level in the ink cartridge mounted on the main body by the information recorded on the discriminating member and by the information items of each ink cartridge stored in the memory.

3 Claims, 5 Drawing Sheets

PRINTER

BACKGROUND OF THE INVENTION

This application claims the benefit of priority to Japanese Patent Application Nos. 2004-092219 filed on Mar. 26, 2004 and 2004-121623 filed on Apr. 16, 2004, both herein incorporated by reference.

1. Field of the Invention

The present invention relates to a printer which performs printing by mounting an ink cartridge containing ink or mounting a so-called pancake-shaped member having an ink ribbon therein, and more particularly to a printer which is designed to prevent an ink cartridge or a pancake-shaped member from being inappropriately reused.

2. Description of the Related Art

Conventional printers determine whether an appropriate ink cartridge is mounted therein by providing discriminating marks that indicate information about an ink ribbon contained in the ink cartridge, or information on colors and types of inks such as a liquid ink or toner, etc, reading the discriminating marks with sensors and by discriminating the information about the ink cartridge, in addition to determining the remaining amount of the ink in the ink cartridge and the appropriateness of the type of ink and printing paper to be used.

As an example of such a printer, a thermal transfer printer using an ink ribbon as ink will be described.

In a conventional thermal transfer printer 51, as shown in FIG. 7, a sheet guide plate 52*b* is formed in an inclined state on the right side (in the drawing) of a bottom plate 52*a* of a main case 52, in which a recording medium 53 is conveyed in the direction of an arrow A on the sheet guide plate 52*b*.

Further, a cylindrical platen roller 54 is rotatably arranged on the left side (in the drawing) of the sheet guide plate 52*b*.

Further, a thermal head 55 composed of a line head is arranged at an upper position facing the platen roller 54.

Here, the thermal head 55 is fastened to a head-mounting stage 56, and the head-mounting stage 56 is mounted to a head lever 57.

In the head lever 57, a round supporting hole 57*a* is formed at a position shown at the right side of the figure, and at a position shown at the other side the thermal head 55 is mounted to be rotatable about the supporting hole 57*a*.

Further, a pair of the head levers 57 is arranged by facing each other to support both long ends of the thermal head 55.

In the main case 52, side plates 52*c* are arranged facing each other, a supporting shaft 58 pivoted to the side plates 52*c* is supported by the supporting hole 57*a*, thus making the head lever 57 is rotatable.

Further, the thermal head 55 engages and disengages the platen roller 54 by a vertical movement, that is, by rotating the head lever 57 up and down about the supporting hole 57*a*.

A paper carrying roller 60 and a pressure contact roller 61 pressure-contacted therewith are arranged at a location further downstream than the platen roller 54 in the direction of the arrow A. Here, the pressure contact roller 61 is rotatably supported by a roller supporting case 62.

Further, an ink ribbon 63 is drawn between a thermal head 55 and the platen roller 54 while moving the thermal head in the upward direction. The ink ribbon 63 is received in a ribbon cartridge 64, its both ends are wound around a winding core 65 and a supplying core 66, and the ribbon cartridge 64 is detachably mounted to a cassette loading portion of the thermal transfer printer 51.

The winding core 65 and the supplying core 66 can be engaged with a winding bobbin 67 and a supplying bobbin 68 arranged in one of the side plates 52*c* of the main case 52.

Further, an ejection roller 69 for ejecting the recording medium 53 after printing is arranged at a location further downstream than the winding core 65 in the direction of the arrow A.

The print operation of the conventional thermal transfer printer 51 as mentioned above will be described. The head lever 57 is rotated up, the thermal head 55 is moved upward and the ribbon cartridge 64 is mounted on thermal printer.

Next, the recording medium 53 is carried in the direction of the arrow A and is supplied between the thermal head 55 in a head-up state and the platen roller 54.

Thereafter, the recording medium 53 which has passed between the thermal head 55 and the platen roller 54 is sandwiched between the paper carrying roller 60 and the pressure contact roller 61, and the thermal head 55 is headed down.

Then, a plurality of heater elements of the thermal head 55 is pressure-contacted with an outer peripheral face of the platen roller 54 with the recording medium 53 and the ink ribbon 63 interposed therebetween.

Next, the heater elements of the thermal head 55 are selectively heated on the basis of print information, and the paper carrying roller 60 is simultaneously rotated in a counterclockwise direction to convey the recording medium, thereby printing an image of desired colors on the recording medium 53.

After printing, the recording medium 53, in a state in which the paper carrying roller 60 and the pressure-contact roller 61 are detached from each other, is ejected to the outside as the paper ejection roller 69 is rotated in a counterclockwise direction.

Also, discriminating marks (not shown) having information, such as colors and types of ink ribbons, recorded thereon are provided on the side of the ink cartridge 64.

Each of the discriminating marks has a reference mark string, an identification mark string and a display space, which are formed on a sheet having a light-reflectable base.

The reference mark string is a set of reference marks indicating time-series references, that is, bit locations of information, and includes bar codes recorded and arrayed in dark portions which do not reflect light and are formed by recording.

Also, the identification mark string is a set of identification marks indicating the information about the ink ribbon and is composed of one-bit information on head location, four-bit information on colors and types of ink ribbons, a four-bit information on sheet number (four bits indicate 20 sheets, 50 sheets, 100 sheets, etc.), a ten-bit information on manufacturing company address, a two-bit information on reserve, which are arranged in order from the head correspondingly to locations of bits of the reference mark string. Moreover, in each bit of the identification mark string, the existence of a bit is recorded correspondingly on a dark portion which does not reflect light, and the non-existence of a bit is recorded correspondingly on the base. In addition, the width of one mark in the direction of the reference mark string is defined narrower than the width of a mark with a bit in the direction of the identification mark string.

Also, the display space is designed to display information on each ink ribbon as described above.

The discriminating marks are provided in such a manner that the array directions of the marks are parallel to the mounting direction of the ink cartridge 64 on the thermal transfer printer 51, that is, the rotation center of each bobbin. Meanwhile, two ink cartridge discriminating sensors (not shown) are attached to the thermal transfer printer 51 to read marks corresponding to the location of the reference mark string and the location of the identification mark string.

Moreover, a recording paper discriminating sensor (not shown) is attached to the thermal transfer printer 51 to read information on the manufacturing company and the quality of paper being used.

In the ink cartridge 64 and the thermal transfer printer 51 constructed this way, the ink cartridge 64 and recording paper are set prior to recording. At this time, information on the ink ribbons is input to a control unit of the thermal transfer printer 51 from each sensor, and information on the recording paper, that is, names of manufacturing companies, quality, etc. is input to the control unit from the paper discriminating sensor. The information obtained by these inputs is edited and displayed by a display unit (not shown) of the thermal transfer printer. If the name of the ink cartridge and the manufacturer of the recording paper do not match, the control unit outputs a warning display like "mismatching," and protection is applied to stop the recording operation. When warning is not displayed, the control unit determines the recording sequence in accordance with the types of ribbon used and the recording operation is executed (for instance, refer to Japanese Unexamined Patent Application Publication No. 05-155123

Such a technique is not limited to the thermal transfer printers using ink cartridges, and is also applied to a thermal transfer printer using a pancake-shaped member that does not contain ink ribbons in the ink cartridge, an inkjet printer using an ink cartridge containing a liquid ink and to a paper printer using an ink cartridge containing toner.

However, in a printer using an ink cartridge having the above-described discriminating unit, only the ink cartridge is discriminated by reading the discriminating marks provided on the an ink cartridge with discriminating sensors. Therefore, when an ink cartridge which has been determined to be appropriate for the printer runs out of ink, users can often reuse the ink cartridge by supplying other ink to the depleted cartridge, or peels off the discriminating mark from the depleted cartridge and attach the mark to another ink cartridge, which is inappropriate. In this case, the printer incorrectly determines the new ink cartridge as being appropriate even though it is not. Because of this, if the new ink is not suitable for the printer, the quality of recording may deteriorate and, in severe cases, the printer may be damaged.

SUMMARY OF THE INVENTION

In view of these problems, it is an object of the present invention to prevent ink cartridges from being reused inappropriately and to provide a printer which does not allow users to use ink inappropriate for the printer.

To achieve the object, the present invention provides a printer comprising an ink cartridge mounted on a main body, ink contained in the ink cartridge, a discriminating member attached to the ink cartridge and having information recorded with on the ink cartridge, the ink cartridge being discriminated by the information recorded on the discriminating member, a memory for individually storing information items of a plurality of the ink cartridges, a control unit for determining a status of ink level in the ink cartridge mounted on the main body by the information recorded on the discriminating member and the information items of each ink cartridge stored in the memory. By adopting this construction, the status of ink status of a certain ink cartridge mounted on the printer is determined. Thus, whether a certain ink cartridge can be used for printer can be determined.

Further, to achieve the object, the present invention provides a printer comprising an ink cartridge mounted on a main body; ink contained in the ink cartridge; a discriminating member attached to the ink cartridge and having information recorded with on the ink cartridge; a reading unit for reading the information recorded on the discriminating member; and a data storage unit for storing the information recorded on the discriminating member read by the reading member, in which when the depletion of the ink contained in the ink cartridge is detected, the information recorded on the discriminating member is stored in the data storage unit to stop other ink cartridge having the discriminating member having the same information as the stored information from being used. According to the printer of this aspect, because the history of ink contained in each ink cartridge in use is stored, it is possible to prevent supplying of another ink to the ink cartridge depleted ink and reuse thereof, and it is also possible to prevent peeling off of the discriminating member from the previous cartridge and attaching thereof to another cartridge. Therefore, the use of ink inappropriate for the printer is prevented, so that the deterioration of recording quality can be prevented in advance.

Furthermore, to achieve the object, the present invention further provides a printer in which a pancake-shaped member having a long ink ribbon both ends of which are respectively wound around a supplying core and a winding core is mounted on the printer. The printer comprises a discriminating member having information on the pancake-shaped member stored in a part of the pancake-shaped member; and a data storage unit for receiving and storing the information the information recorded on the discriminating member, in which when an end of the ink ribbon is detected, the information recorded on the discriminating member is stored in the data storage unit, to stop other pancake-shaped member having the same information as the stored information from being used. According to the printer of this aspect, because the information from the discriminating mark in the pancake-shaped member is stored, the use of the pancake-shaped member including a discriminating mark having the same information as a discriminating mark used in the previous pancake-shaped member depleted of ink is reliably prevented. Therefore, the use of ink inappropriate for the printer is prevented, so that the deterioration of recording quality can be prevented in advance.

DESCRIPTION OF THE PREFERRED EMBODIMENTS

Figure 1:
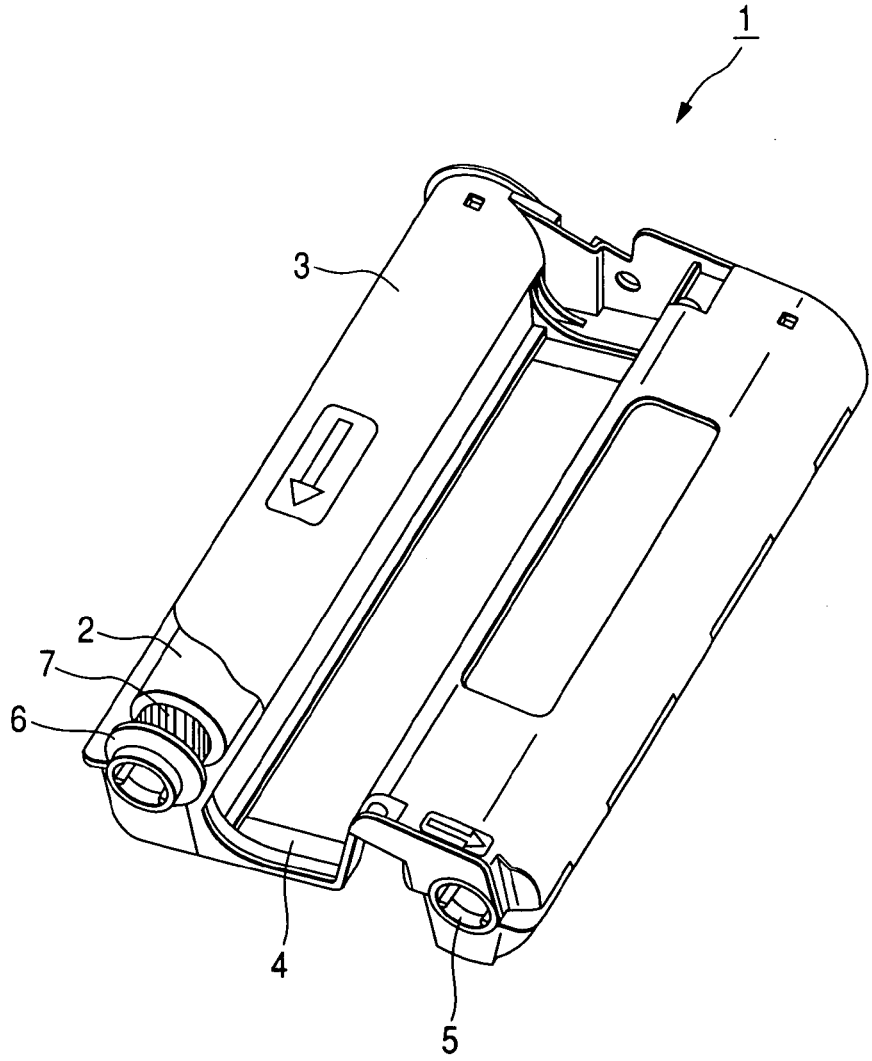
FIG. 1 is a partially cutaway perspective view showing an ink cartridge a first embodiment of the present invention.
Figure 2:
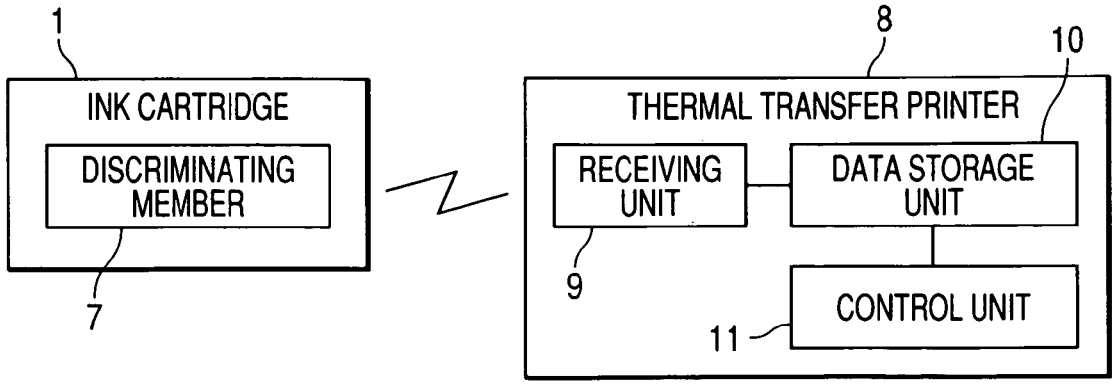
FIG. 2 is a block diagram showing a construction of main parts of a printer and the ink cartridge according to the first embodiment.

FIG. 1 is a partially cutaway perspective view showing a thermal transfer printer as example of a printer of an ink cartridge used for according to a first embodiment the present invention, and FIG. 2 is a block diagram showing a construction of main parts of the thermal transfer printer and the ink cartridge according to the present embodiment.

In the thermal transfer printer according to the present embodiment, the detailed description about the same construction as that of the above-mentioned conventional thermal transfer printer is omitted herein, and the features of the present embodiment will be described in detail.

In the present embodiment, an ink cartridge 1, as shown in FIG. 1, is constructed to receive an ink ribbon 2 in a main case 3, and the ink cartridge 1 is used in a state mounted on a cartridge mounting portion provided in the thermal transfer printer.

The ink ribbon 2, for example, is obtained by repeatedly forming a three-color layer of cyan (C), magenta (M) and yellow (Y) in this order (which black (B) or transparent overcoat ink (OP) are added in the layer if necessary) on a long film substrate made of a resin such as PET in a longitudinal direction of the film substrate. Further, a forming area for each ink on the ink ribbon 2 is formed to be slightly larger than a recording area of a recording medium used in the thermal transfer printer. Further, a terminating end mark (not shown) indicating a terminating end of the ink ribbon is formed at a terminating end of the ink ribbon 2. Further if a detecting sensor provided in the thermal transfer printer detects the terminating end mark, the thermal transfer printer stops recording and sends to a user an alarm indicating that the ink ribbon 2 of the ribbon cartridge 1 has stopped.

Moreover, as shown in FIG. 1, a concave thermal head inserting portion 4 is formed at the center of the main case 3 for allowing the thermal head of the thermal transfer printer to be arranged to face the ink ribbon 2 which is led out of the main case 3.

Moreover, a winding reel 5 for winding the ink ribbon 2 having a supplying reel 6 wound with an unused ink ribbon 2 are rotatably arranged in the main case 3. Also, both ends of the ink ribbon 2 are wound around outer peripheral faces of the respective reels 5 and 6 so that a part of the ink ribbon 2 is exposed to the outside from the main case 3. Further, the supplying reel 6 follows the rotation of the winding reel 5 via the ink ribbon 2.

Also, when the ribbon cartridge 1 is mounted on the cartridge mounting portion of the thermal transfer printer, the winding reel 5 and supplying reel 6 are respectively engaged with a winding bobbin or supplying bobbin of the thermal transfer printer, and the ink ribbon 2 is wound around the winding reel 5 by the rotation of the winding bobbin.

Moreover, a discriminating member 7 for recording information on a manufacturing company of an ink cartridge 1, discriminating information, for example, a serial number, for discriminating ink cartridges from each other, and information on types and a recordable number of sheets of ink ribbons received in ink cartridges, is attached to the cassette case 3.

As the discriminating member 7, for example, an RF tag composed of a non-contact IC chip and an antenna for communication are used, and information recorded in the RF tag is transmitted to a receiving unit 9 of the thermal transfer printer 8, which will be described later, via a wireless means.

Also, as shown in FIG. 2, the thermal transfer printer 8 according to the present embodiment comprises a receiving unit 9 for receiving information when respective information items recorded on the discriminating member 7 of the ink cartridge 1 mounted on the cartridge mounting portion are transmitted, a data storage unit 10 for storing the received information, and a control unit 11 for discriminating the ink cartridge 1 on the basis of respective information items stored in the data storage unit 10 and for controlling each unit of the thermal transfer printer 8.

Also, because the data storage unit 10 stores discriminating information of each ink cartridge 1 mounted on the thermal transfer printer 8, information on a recordable sheet number of each ink cartridge 1, and a recorded history of the each ink cartridge 1, a memory having sufficient capacity to record data or a memory using a serial latch structure or a ring buffer structure is used as a memory of the data storage unit 10.

Also, the control unit 11 is designed to discriminate whether the mounted ink cartridge 1 is appropriate for the thermal transfer printer 8 on the basis of the information on the manufacturing company stored in the data storage unit 10 after being received from the receiving unit 9, and to detect the remaining amount (the remaining recordable number of sheets) of the ink ribbon 2 of the ink cartridge 1 by comparing current discriminating information and information on the recordable number of sheets with previous discriminating information and information on the recordable number of sheets stored in the data storage unit 10. Further, when the detecting sensor of the thermal transfer printer detects the terminating end of the ink ribbon 1 or when a total recordable number of sheets reaches the recordable number of sheets, the data storage unit 10 records information indicating the depletion of the ink cartridge 1 of the discriminating information on the discriminating information of the ink ribbon cartridge 1.

Next, functions of the thermal transfer printer according to the present embodiment will be described.

Figure 3:
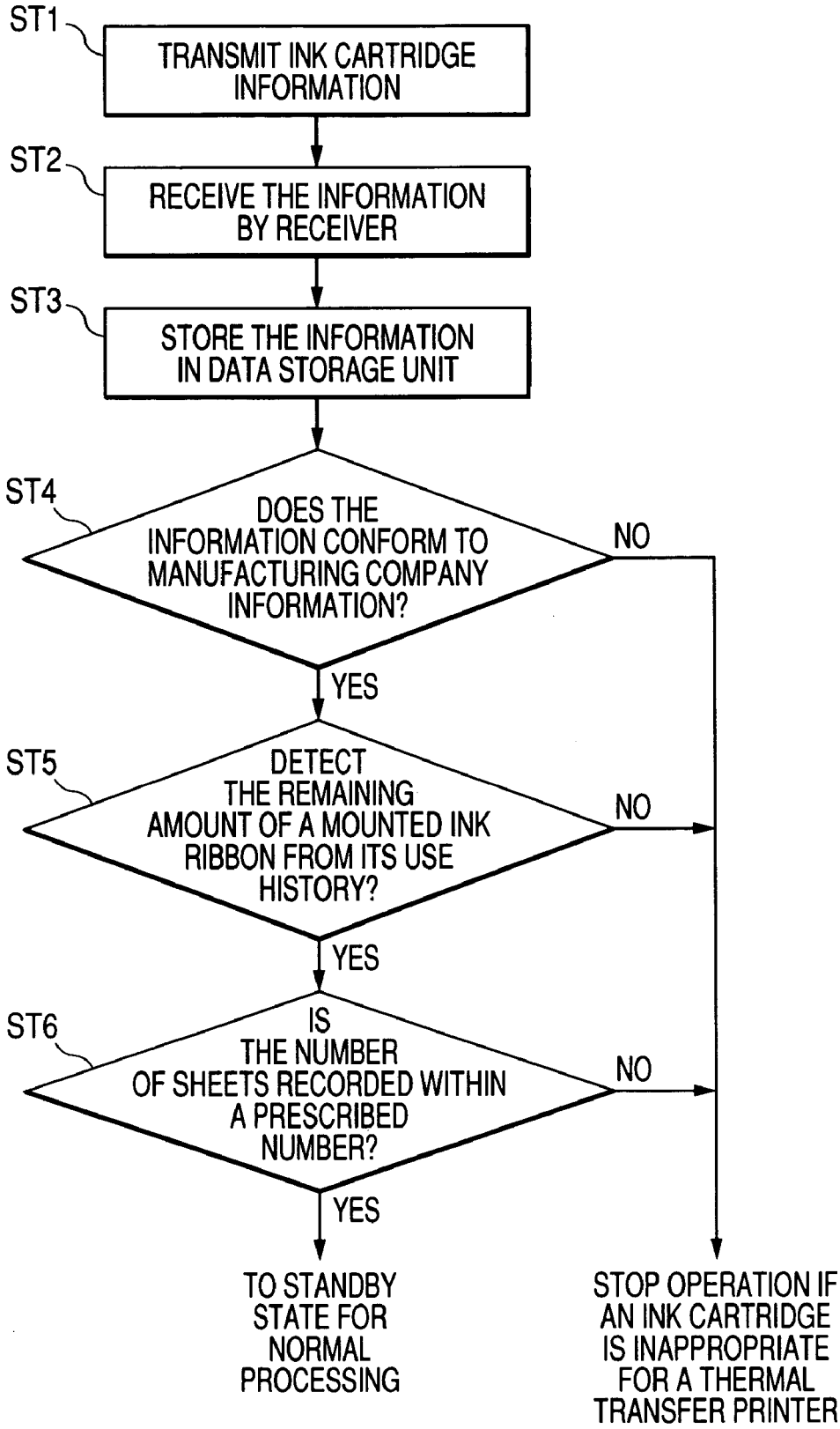
FIG. 3 is a flow chart showing a control of a discriminating method for the ink cartridge in the printer according to the present embodiment.

FIG. 3 is a flow chart showing a control of a discriminating method for the ink cartridge in the printer according to the present embodiment.

First, when the ink cartridge 1 is mounted on the cartridge mounting portion of the thermal transfer printer 8, as shown in Steps ST1 to ST3, the discriminating member 7 provided in the ink cartridge 1 transmits stored discriminating information, the thermal transfer printer 8 receives the transmitted discriminating information by the receiving unit 9 and stores the information in the data storage unit. Then, as shown in Step ST4, the control unit 11 compares the received discriminating information with the information stored in the data storage unit, discriminates whether the manufacturing company of the mounted ink cartridge 1 is appropriate for the thermal transfer printer 8.

At this time, if it is determined that the ink cartridge 1 is inappropriate for the thermal transfer printer 8, the preparation for recording stops, whereas if it is determined that the ink cartridge 1 is appropriate for the thermal transfer printer 8, as shown in Step ST5, the remaining amount of the ink ribbon 2 is detected from the information on the recordable number of sheets recorded on the discriminating member 7 and the recorded history of the ink ribbon 2 of the ink cartridge stored in the data storage unit 10, and the recording is prepared.

In addition, from the mounting history and recorded history stored in the data recording unit 14, if it is determined the ink ribbon 2 of the ink cartridge 1 is depleted, the preparation for recording stops. That is, as shown in Step STI4, in an ink cartridge appropriate for the thermal transfer printer 12, when the depleted ink ribbon 2 is replaced with another ink ribbon and the replaced ribbon cartridge is mounted on the thermal transfer printer, on the basis of the recorded history of the ink cartridge 1 stored in the data recording unit 14, the control unit 15 determines that the ribbon cartridge us depleted and the preparation for recording stops.

As described above, according to the thermal transfer printer of the present embodiment, because the discriminating information on each ink cartridge 1 in use along with the history of the ink ribbon 2 about the ink cartridge 1 is stored in the data storage unit 10, the replacement of ink ribbon in the depleted ink cartridge 1 and the use of another ribbon cartridge to which the discriminating member 7 is attached are prevented. Therefore, the use of an ink ribbon inappropriate for the thermal transfer printer is prevented, so that the deterioration of quality is prevented in advance. Also, the ink cartridge 1 inappropriate for the thermal transfer printer 8 is detected, so that the use of the ink cartridge is also prevented in advance.

Next, a second embodiment of the present invention will be described by taking a thermal transfer printer as an example in the same manner as the first embodiment. In addition, only a different construction from the above-described first embodiment will be described.

Figure 4:
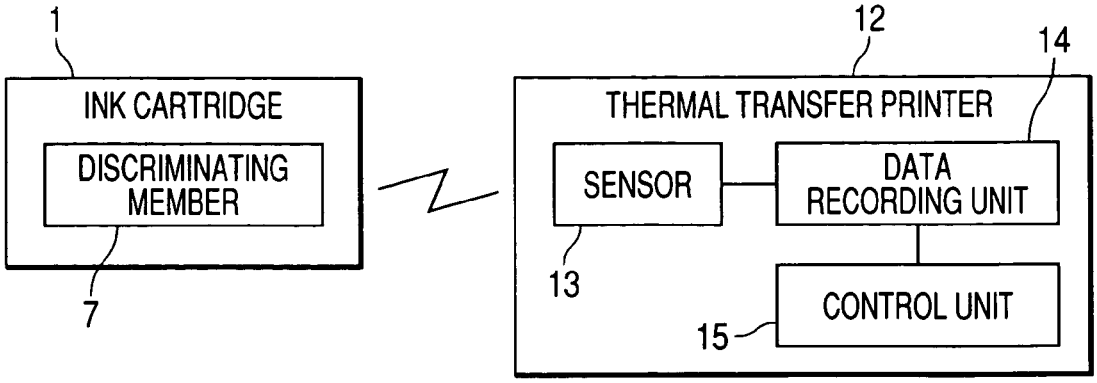
FIG. 4 is a block diagram showing a construction of main parts of a printer and an ink cartridge according to a second embodiment of the present invention.

In the present embodiment, as shown in FIG. 4, information composed of, for example, the discriminating member 7 has information on the types of ink ribbons and identification information on the name of a manufacturing company printed in bar codes thereon, and the thermal transfer printer 12 comprises a reading sensor 13 for reading the bar codes.

Also, the thermal transfer printer 12 according to the present embodiment uses recording media having the same size and a constant amount of ink, and comprises a data recording unit 14 as a memory for storing each information item read by the sensor 13 and storing the recorded history (number of sheets recorded) of the ink cartridge 1, and a control unit 15 for discriminating the ink cartridge 1 on the basis of each information item stored in the data recording unit 14 and for controlling each unit of the thermal transfer printer.

Further, because the data recording unit 14 stores the discriminating information of each ink cartridge 1 mounted on the thermal transfer printer 12, the information on the recordable number of sheets in each cartridge, and the information on the recorded history (number of sheets recorded) of each ink cartridge, it is preferable that a memory having a sufficient capacity to record data, or a FIFO (first in first out) memory such as a memory using a serial latch structure or a ring buffer structure is used as a memory of the data recording unit 14.

Further, the control unit 15 is designed to discriminate whether the mounted ink cartridge 1 is appropriate for the thermal transfer printer 12 on the basis of information on a manufacturing company, which is read by the sensor 13 and stored in the data recording unit 14, and to detect the remaining ink ribbon of the ink cartridge mounted by comparing the discriminating information and information on the recordable number of sheets, which are read by the sensor 13, with the discriminating information and the information on the recordable number of sheets, which are stored in the data recording unit 14.

Next, functions of the thermal transfer printer according to the second embodiment will be described.

Figure 5:
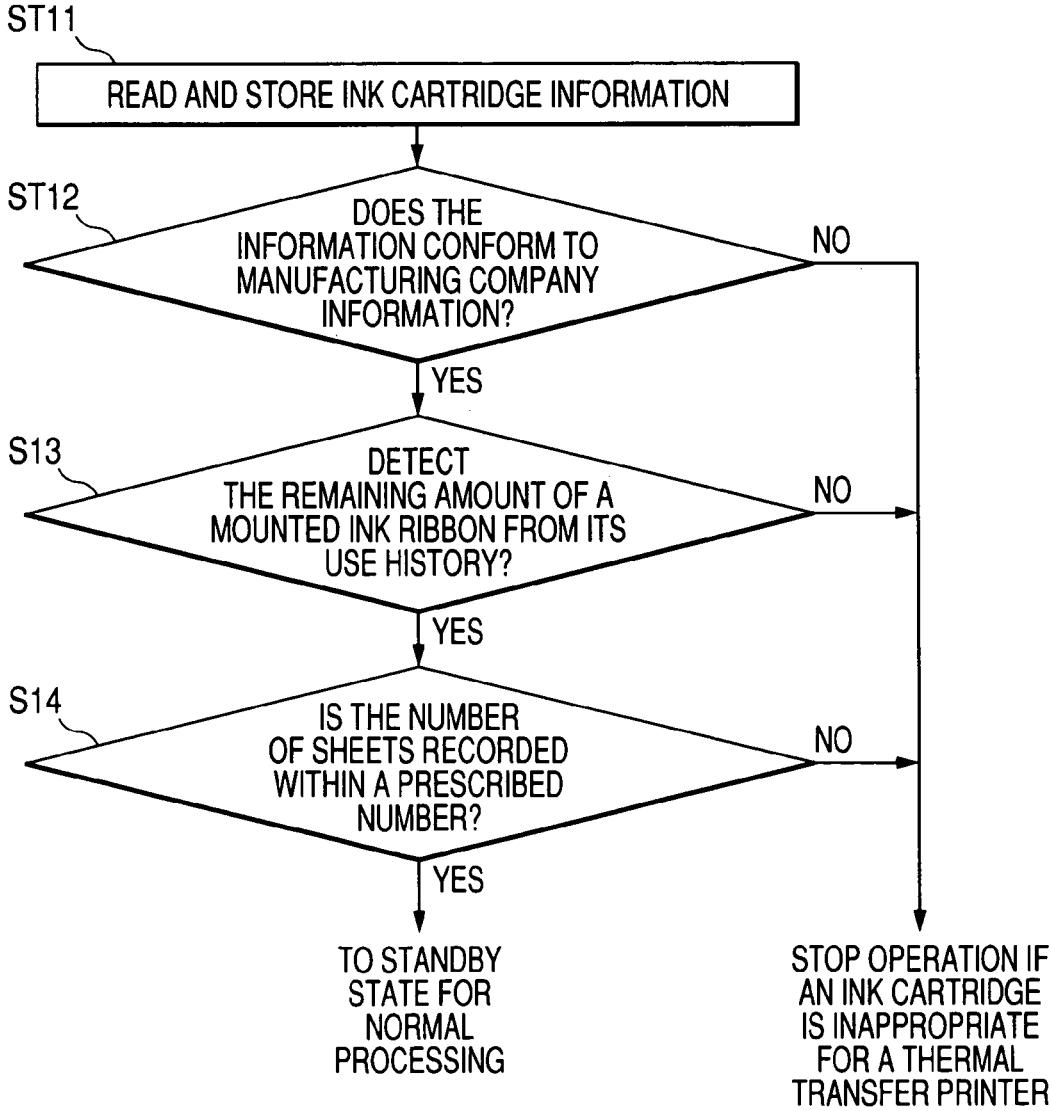
FIG. 5 is a flow chart showing a control of a discriminating method for the ink cartridge in the printer according to the second embodiment of the present invention.

FIG. 5 is a flow chart showing a control of a discriminating unit for the ink cartridge in the printer according to the present invention.

First, when the ink cartridge 1 is mounted on the thermal transfer printer 1, as shown in Step ST11, the sensor 12 reads each information item from the discriminating member 7 of the ink cartridge 1, the read information items are sequentially stored in the data recording unit 14. Further, as shown in Step ST12, the control unit 15 compares the read information with the information stored in the data recording unit 14, and discriminates whether the manufacturing company of the ink cartridge 1 is appropriate for the thermal transfer printer 12.

At this time, if it is determined that the ink cartridge 1 is inappropriate for the thermal transfer printer 12, a preparation for recording stops, whereas if it is determined that the ink cartridge 1 is appropriate for the thermal transfer printer 12, as shown in Step ST13, the remaining amount of the ink ribbon 2 is detected from the information on the recorded history of the ink ribbon 2 stored in the data recording unit 14, the recordable number of sheets recorded in the discriminating member 7, and the ink consumption of the thermal transfer printer 12, and the recording is prepared.

In addition, from the mounting history and recorded history stored in the data recording unit 14, if it is determined the ink ribbon 2 of the ink cartridge 1 is depleted, the preparation for recording stops. That is, as shown in Step ST14, in an ink cartridge appropriate for the thermal transfer printer 12, when the depleted ink ribbon 2 is replaced with another ink ribbon and the replaced ribbon cartridge is mounted on the thermal transfer printer, on the basis of the recorded history of the ink cartridge 1 stored in the data recording unit 14, the control unit 15 determines that the ribbon cartridge 1 is depleted and the preparation for recording stops.

As described above, according to the discriminating unit of the ink cartridge in the printer of the present embodiment, because the history of the ink contained in each ink cartridge 1 for use is stored in the data recording unit 15, the control unit 15 can detect the remaining amount of the ink on the basis of the data recording unit 14, it is possible to prevent the supply of another ink to the depleted ink cartridge 1 and to prevent the reuse of the ink cartridge. Therefore, the use of ink inappropriate for the printer is prevented, so that the deterioration of recording quality can be prevented in advance.

Further, the ink cartridge 1 inappropriate for a thermal transfer printer 12 can be detected in advance.

Further, the present invention is not limited to the above-described embodiments and can be modified in various forms, if necessary. For example, if a printer to be used has a display unit, each information item of the ink cartridge mounted on the printer can be displayed on the display unit.

When the memory for storing the discriminating information of the ink cartridge has a predetermined capacity, the present embodiment has been described with respect to having a sufficient capacity to store the total number of sheets recorded, which is guaranteed by the printer. However, for example, by using a memory with a ring buffer structure, it is possible to use a memory having a capacity less than the required capacity to store the total number of sheets recorded, which is guaranteed by the printer.

For example, if the recording of 1,000,000 sheets is guaranteed as a printer's life span and 1,000 sheets can be printed for one ink cartridge. From an equation 1,000,000/1,000=1,000, in case of using a general memory, a memory having a sufficient capacity to store data equivalent to 1,000 ink cartridges is necessary, but by using a storing memory with a ring buffer structure, information items on $1^{st}$ to $500^{th}$ ink cartridges are stored in order, and information items on $501^{st}$ or more ink cartridges are sequentially written over an information item on the $1^{st}$ ink cartridge to $500^{th}$ ink cartridge. Since this enables the information items on up to 500 ink cartridges from the cassette being currently used toward the oldest one to be stored in the memory, it is possible to use a memory having a less capacity than the capacity needed for 1,000 ink cartridges.

In the present embodiment, the ink ribbon 2 uses multi-colored ribbons with a color ink portion repeatedly formed in the recording direction, but ink ribbons with single colors repeatedly formed to ends of the ribbons may be used. In this case, the discriminating members may be individually attached to the respective ink cartridges containing single colored ink ribbons, and sensors which can read information of the respective discriminating members may be installed in the printer. Further, it is preferable to install a plurality of sensors. Further, in case of using single-colored ribbons, in addition to the information on the manufacturing company, discriminating information and information on the amount of ink, information on the color of ink ribbon is recorded in each discriminating member.

Furthermore, the ink cartridge 1 according to the present embodiment is used as the ink ribbon cassette 3 which receives the ink ribbon 2, and the thermal transfer printer is used as the printer, but an inkjet printer in which the ink cartridge 1 contains a liquid ink can be used as the printer. Further, in this case, the inkjet printer is limited to a printer in which a prescribed amount of ink is consumed in units of recording amounts. Moreover, a page printer in which the ink cartridge 1 contains toner can be used as the printer.

In the inkjet printer or the page printer, similar to the above-described thermal transfer printer, the discriminating member which stores each information item on the ink cartridge and information on the ink is installed in the ink cartridge, the information is obtained by transmitting the information recorded on the discriminating member by radio or by reading it with a reading member installed in the printer, and thus the same effect can be obtained by performing a process similar to the process described for the thermal transfer printer.

Moreover, as another embodiment, besides the thermal transfer printer in which the ink ribbon is received and used in the ink cartridge, it is possible to use a thermal transfer printer in which the ink ribbon is mounted and used on the main body of the printer in the pancake configuration. In this case, it is preferable to install the discriminating member 7 in the supplying reel or the winding reel. In addition, as the thermal transfer printer using the ink ribbon in the pancake configuration, a thermal transfer printer of an intermediate transfer system as shown in FIG. 6 is more appropriate.

Figure 6:
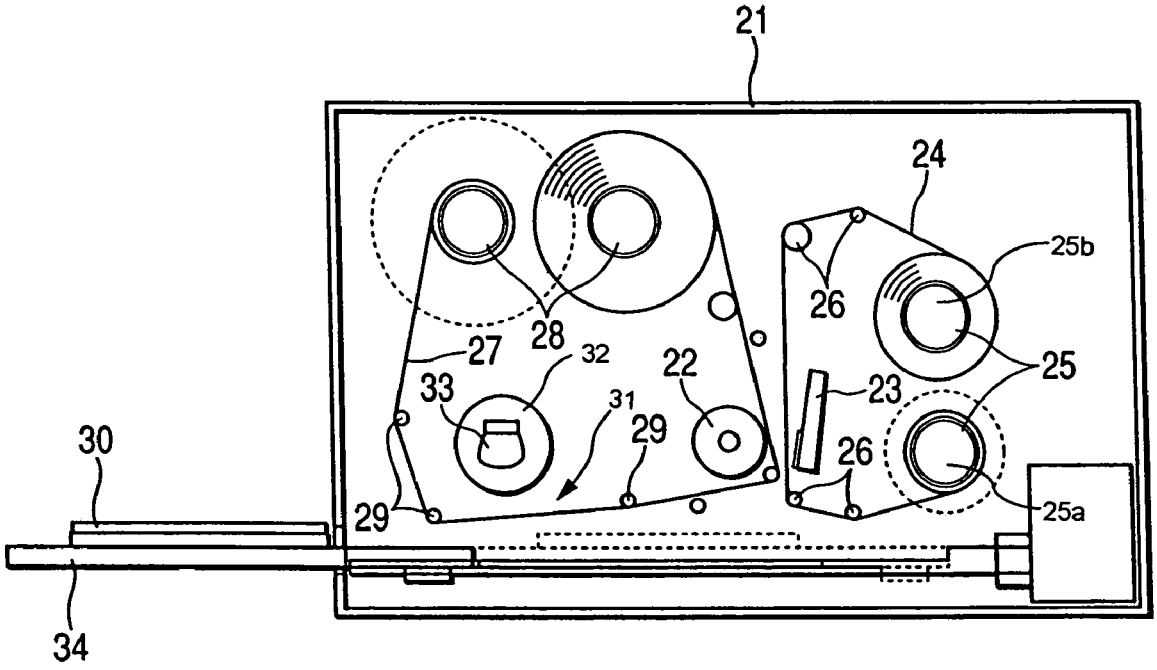
FIG. 6 is a view showing a construction of main parts of an intermediate transfer type thermal transfer printer according to a third embodiment of the present invention.
Figure 7:
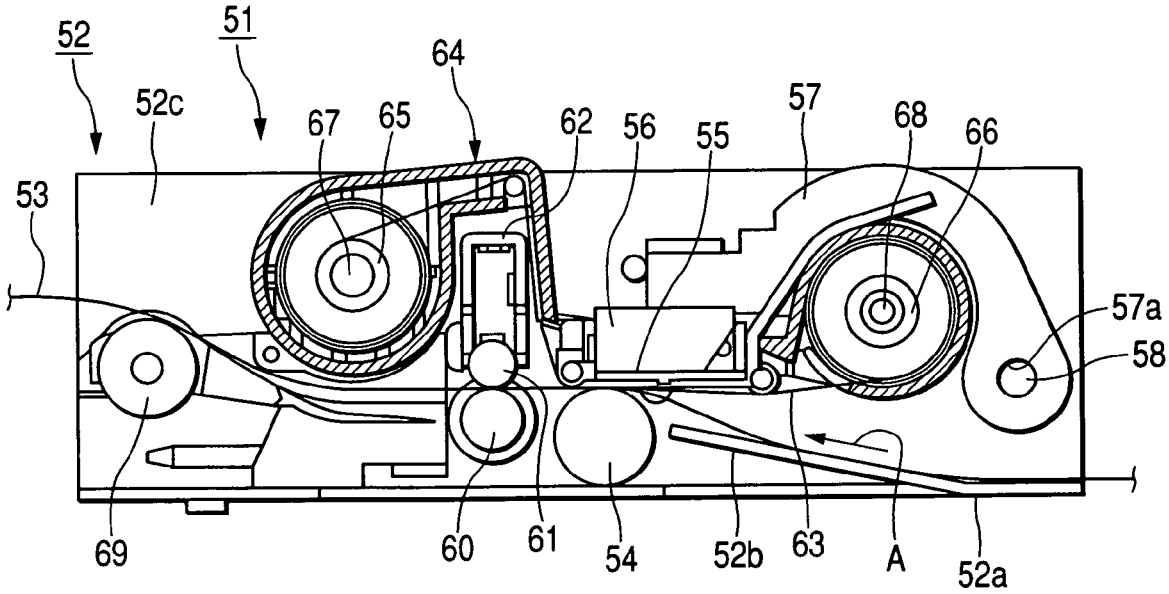
FIG. 7 PRIOR ART
FIG. 7 is a view showing a construction of main parts of a conventional thermal transfer printer.

In a thermal transfer printer 21 of an intermediate transfer system shown in FIG. 6, a cylindrical platen roller 22 is rotatably arranged, and in a position facing the platen roller 22, a thermal head 23 having a plurality of heater elements linearly aligned is arranged to be pressure-contactable with the platen roller 22.

Further, a supplying reel 25*a* and a winding reel 25*b* around which an ink ribbon 24 is wound are arranged at one side of the thermal head 23, and the ink ribbon 24 is used in the pancake configuration. Also, while the ink ribbon 24 is supported by a plurality of ribbon guide rollers 26 and 26, the ink ribbon is guided between the platen roller 22 and the thermal head 23. Additionally, a discriminating member (not shown) similar to that of the above-described first and second embodiments is provided in any one of the supplying reel 25*a* or the winding reel 25*b*, and a reading unit, a data storage unit, a control unit, etc. (all of which are not shown) similar to those of the above described first and second embodiments are provided in the printer 21.

Moreover, a pair of sheet rolls 28 and 28 having wound with an intermediate transfer sheet 27 is arranged at an upper portion of the printer 21 as an intermediate transfer medium. The intermediate transfer sheet 27 is drawn out of one from the sheet roll 28 while being supported by a plurality of sheet guide rollers 29 and 29, passes between the thermal head 23 and the platen roller 22, moves horizontally at a lower side of the printer 21, is guided toward an upper side of the printer 21, and is wound around the other sheet roll 28. Then, an image to be recorded on a recording medium 30 is temporarily transferred to the intermediate transfer sheet 27 via the ink ribbon 24 by the thermal head 23.

Further, a retransfer portion 31 which retransfers the ink which has been temporarily transferred to the intermediate transfer sheet 27 to the recording medium 30 is provided at a position above a horizontally guided portion of the intermediate transfer sheet 27, at a lower side of the printer 21. In the retransfer portion 31, a heat roller 32 passes through the intermediate transfer sheet 27 and is arranged to be freely separable from the recording medium 30. Further, a halogen lamp 33 as a heating means is built in the heat roller 32, and a conveying table 34 for conveying the recording medium 30 to the retransfer portion 31 is arranged at the lower side of the printer 21.

In such a thermal transfer printer 21 of an intermediate transfer system, in a state that the recording medium 30 has been moved to the transfer portion by moving the conveying table 34, each element of the thermal head 33 are driven on the basis of desired image information, and a primary image is recorded by transferring the ink of the ink ribbon 24 to the intermediate transfer sheet 27. Then, the intermediate transfer sheet 27 is conveyed to the retransfer portion 31, the heat roller 32 is pressure-contacted with the recording medium 30 via the intermediate transfer sheet 27, and the intermediate sheet 27 and the conveying table 34 are moved at the same speed, thereby retransferring the primary image from the intermediate transfer sheet 27 to the recording medium 30 to record the image on the recording medium 30.

In addition, the process of receiving and processing information from the discriminating member and according to the present embodiment is the same as that of the above-described first and second embodiments, and therefore a detailed description thereof is omitted.

What is claimed is:

1. An intermediate transfer type thermal transfer printer in which a pancake-shaped member having a long ink ribbon having a terminating end mark indicating a terminating end and both ends of which are respectively wound around a supplying core and a winding core is mounted on the printer, the printer comprising:

a discriminating member disposed on at least one of the supplying core and the winding core and having information on the pancake-shaped member, including at least discriminating information, information on a recordable number of sheets and information on colors of the ink ribbon;

a detecting sensor that detects the terminating end mark of the ribbon;

a readout member for reading out the information of the discriminating member;

a data storage unit for storing the information recorded on the discriminating member on the pancake-shaped member, which is read out by the readout member, and mounting histories and print histories of all the pancake-shaped members which are mounted on the main body; and a control unit that stores the information of the discriminating member which is read out by the readout member in the data storage unit and determines a status of the pancake-shaped member mounted in the main body on the basis of the discriminating information and the information on the recordable number of sheets which are stored in the data storage unit, wherein the control unit determines whether the ink cartridge is appropriate for the printer or not on the basis of the discriminating information, to stop the preparation of recording when the ink cartridge is inappropriate for the printer, and to detect a remaining amount of the ink ribbon on the basis of the information on the recordable number of sheets and mounting history and recorded history stored in the data storage unit when the ink cartridge is appropriate for the printer, and when the terminating end of the ink ribbon is detected by the detecting sensor, or when it is determined that the number of printed sheets reaches a printable limit number, the information recorded on the discriminating member is stored in the data storage unit, and then the preparation for recording is stopped when the pancake-shaped member having the same information as the stored information is mounted.

2. The printer according to claim 1, wherein the information of the discriminating member includes maker information and end information.

3. The intermediate transfer type thermal transfer printer according to claim 1, wherein the information on colors of the ink ribbon is information for identifying an ink ribbon in which color ink portions are repeatedly formed or an ink ribbon in which single color is continuously formed to ends of the ink ribbon, and the control unit discriminates the information on colors of the ink ribbon.

* * * * *